United States Patent [19]

Yamanaka

[11] Patent Number: 4,794,025

[45] Date of Patent: Dec. 27, 1988

[54] ORNAMENT FOR WINDOW DISPLAY

[75] Inventor: Kichinosuke Yamanaka, Tokyo, Japan

[73] Assignee: Kabushiki Kaisha Bandai, Tokyo, Japan

[21] Appl. No.: 130,319

[22] Filed: Dec. 8, 1987

[30] Foreign Application Priority Data

Jul. 14, 1987 [JP] Japan ..... 62-107906[U]

[51] Int. Cl.[4] ..... A63H 3/16

[52] U.S. Cl. ..... 428/31; 248/205.5; 272/8 N; 446/177; 446/268; 428/16

[58] Field of Search ..... 40/160, 538, 597; 248/205.5, 915; 446/177, 268; 428/15, 16, 31; 272/8 N

[56] References Cited

U.S. PATENT DOCUMENTS 3,988,792 11/1976 Klein ..... 428/16 XR
4,093,165 6/1978 Sussman ..... 248/206 R
4,594,950 6/1986 Morris ..... 428/16 XR

FOREIGN PATENT DOCUMENTS 732092 6/1955 United Kingdom ..... 428/900

OTHER PUBLICATIONS

"Big George", by Virgil Partch, p. E49 The Washington Post Saturday, Feb. 28, 1981.

*Primary Examiner*—Henry F. Epstein
*Attorney, Agent, or Firm*—R. Gale Rhodes, Jr.

[57] ABSTRACT

An ornamental article for window display is constructed of first and second hollow ornamental article sections to be mounted on a transparent member, the two sections being cut and divided at any plane surface of the body of the ornamental article. Each ornamental article section includes a boss formed within the hollow ornamental article section, the boss being formed therein with a first threaded portion along its longitudinal axis extending substantially perpendicular to the end surface of the divided section, and an attachment unit having a sucking device and a shaft formed integrally therewith, the shaft being formed outside thereof with a second threaded portion which meshes with the first threaded portion. When both the first and second hollow ornamental article sections is attached to a transparent plate member by means of the attachment unit, the ornamental article can be visually recognized as if it penetrated through the transparent plate member, and the attachment unit cannot be visually recognized from the outside.

2 Claims, 1 Drawing Sheet

ORNAMENT FOR WINDOW DISPLAY

BACKGROUND OF THE INVENTION

1. Field of the Invention

The present invention relates to an ornamental article for window display which article is visually recognized as if it penetrated through the window.

2. Related Background Art

Conventional ornamental articles to be displayed on a window glass of an automobile, a shop or the like have been provided with attachment means by which the article can be detachably fixed on the window glass. The attachment means include a sucking device made of soft plastics, an adhesive tape or the like. However, these conventional attachment means have been found not satisfactory for the purpose of window display, because not only the display objective, i.e., an ornamental article but also the attachment means are visually recognized. Therefore, the display effect is reduced.

SUMMARY OF THE INVENTION

It is therefore an object of the present invention to provide an ornamental article which does not reduce the display effect and can be visually recognized as if it penetrated through the window, when it is displayed on a window.

To achieve the above object, the ornamental article for window display according to the present invention comprises first and second hollow ornamental article sections which constitute the ornamental article when abutting them together at end surfaces thereof along which the ornamental article is divided into the first and second hollow ornamental article sections; each of the first and second ornamental article sections comprising a boss formed within the hollow ornamental article section, the boss being formed therein with a first threaded portion along its longitudinal axis extending substantially perpendicular to the end surface; and attachment means comprising a suction device and a shaft formed integrally therewith, the shaft being formed outside thereof with a second threaded portion which meshes with the first threaded portion.

The suction device is made of soft plastics for attachment with the transparent plate member, or alternately is made of a permanent magnet.

Therefore, when both the first and second hollow ornamental article sections are attached to a transparent plate member by means of the attachment means, the ornamental article can be visually recognized as if it penetrated through the transparent plate member and the attachment means can not be visually recognized from the outside.

BRIEF DESCRIPTION OF THE DRAWINGS

Other features and advantages of the invention will become apparent from the following description taken in connection with the accompanying drawing wherein.

DETAILED DESCRIPTION OF THE PREFERRED EMBODIMENT

Figure 1:
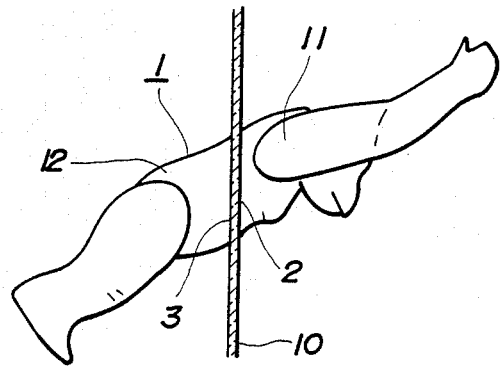
FIG. 1 is a side view illustrating a mount of an embodiment of an ornamental article on a plate glass according to the present invention.
Figure 2:
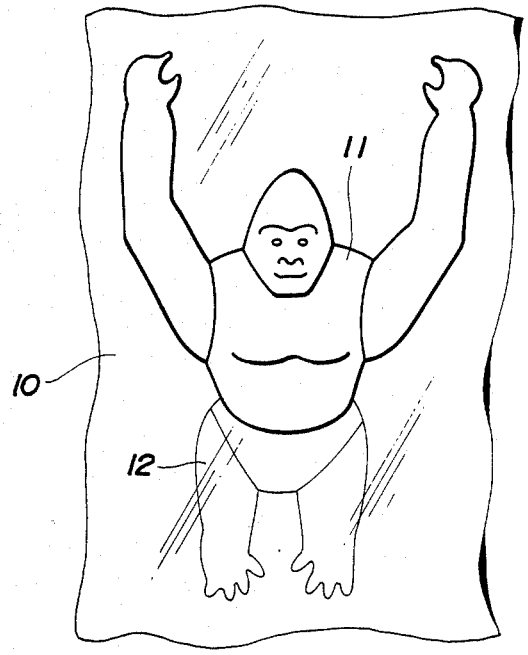
FIG. 2 is a front view similar to FIG. 1.
Figure 3:
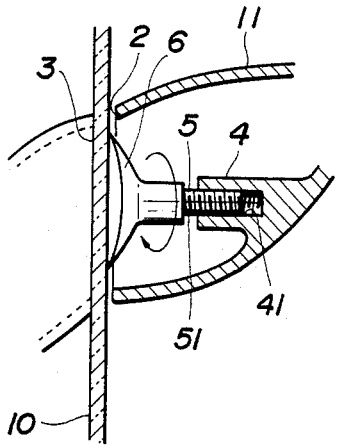
FIG. 3 is a sectional side view showing the attachment means provided inside one half of the ornamental article.

The present invention will now be described with reference to the accompanying drawing which shows an embodiment of the ornamental article. In the Figures, reference number 1 denotes an ornamental article which in this embodiment simulates a gorilla. The ornamental article 1 is constructed of first and second article sections 11 and 12, each section having been molded using soft plastics and having an empty portion within it. The first and second hollow article sections 11 and 12 each have an end surface 2 or 3 along which the ornamental article 1 is slantwise divided into the two sections 11 and 12. Each of the first and second hollow article sections 11 and 12 is formed with a boss 4 at the empty portion, as shown in FIG. 3. The boss 4 has formed therein a threaded portion 41 along its longitudinal axis which is perpendicular to the end surface 2.

The first and second ornamental article sections 11 and 12 each are provided further with an attachment means for detachably mounting the ornamental article section 11 or 12 on a plate glass 10.

The attachment means comprises a shaft 5 and a suction device 6 formed integrally therewith as shown in FIG. 3. The suction device 6 is formed with soft plastics, as well known in the art, for the attachment to the surface of the plate glass 10. The shaft 5 is formed outside thereof with a threaded portion 51 which meshes with the first-mentioned threaded portion 41 of the boss 4.

With the ornamental article sections 11 and 12 constructed as above, it is possible to mount the ornamental article 1 on the plate glass 10 in such a manner as if it penetrated through the glass 10 without the attachment means being visually recognized. Particularly, by minutely adjusting the degree of threading the shaft 5 into or out of the boss 4, the suction device 6 can be positioned near the end surface 2 and hence at the plate glass 10. Thus, the hollow ornamental article section 11 can be mounted on the glass 10 by means of the suction device 6. The other hollow ornamental article section 12 can be mounted in a similar manner to the glass 10 at the opposite surface thereof.

Instead of the suction device 6 as described above, this may be replaced with a permanent magnet, one having a polarity opposite to the other, respectively mounted on the first and second hollow ornamental article sections 11 and 12.

As described so far, according to the present invention, the ornamental article such as a doll, toy animal, or any other decorative article to be mounted on a window or the like is constructed of two halves of the divided ornamental article. Since the suction device is formed within each of the divided ornamental article section and can be minutely adjusted to properly position it near the surface of the window, the ornamental article mounted on the window is visually recognized as if it penetrated through the window. Also, since the attachment means is not recognized from the outside, the display effect is not deteriorated thus enabling an attractive and novel window display.

While a preferred embodiment of the invention has been described, variations thereto will occur to those skilled in the art. The scope of the invention, therefore, is to be determined soley by the following claims.

What is claimed is:

1. An ornamental article for window display and for attachment to a transparent plate member comprising:

first and second hollow ornamental article sections which constitute said ornamental article when abutting them together at end surfaces therof along which said ornamental article is divided into said first and second hollow ornamental article sections;

each of said first and second ornamental article sections comprising:

a boss formed within said hollow ornamental article section, said boss being formed therein with a first threaded portion along its longitudinal axis extending substantially perpendicular to said end surface; and attachment means comprising a suction device and a shaft formed intgrally therewith, said shaft being formed outside thereof with a second threaded portion which meshes with said first threaded portion to minutely adjust the degree of threading of said shaft into or out of said boss to position said suction device substantially at said end surface and hence at said transparent plate member;

whereby when both said first and second hollow ornamental article sections are attached to said transparent plate member by means of said attachment means, said ornamental article can be visually recognized as if it penetrated through said transparent plate member without said attachment means being visually recognized.

2. An ornamental article for window display according to claim 1, wherein said suction device is made of soft plastics for attachment with said transparent plate.

* * * * *